United States Patent [19]

Eisenbeis

[11] Patent Number: 4,829,288

[45] Date of Patent: May 9, 1989

[54] ECONOMIC, MULTI-DIRECTIONALLY RESPONSIVE MARKER FOR USE IN ELECTRONIC ARTICLE SURVEILLANCE SYSTEMS

[75] Inventor: Clyde T. Eisenbeis, Oakdale, Minn.

[73] Assignee: Minnesota Mining and Manufacturing Company, St. Paul, Minn.

[21] Appl. No.: 126,749

[22] Filed: Nov. 30, 1987

[51] Int. Cl.[4] ..... G08B 13/24; G08B 13/14

[52] U.S. Cl. ..... 340/551; 340/572

[58] Field of Search ..... 340/551, 572; 335/227, 335/229, 231, 306

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 3,790,945 | 2/1974 | Fearon | 340/280 |
| 4,074,249 | 2/1978 | Minasy | 340/280 |
| 4,075,618 | 2/1978 | Montean | 340/280 |
| 4,222,517 | 9/1980 | Richardson | 340/572 |
| 4,249,167 | 2/1981 | Purinton et al. | 340/572 |
| 4,300,183 | 11/1981 | Richardson | 361/152 |
| 4,710,754 | 12/1987 | Montean | 340/572 |
| 4,743,890 | 5/1988 | Hilzinger et al. | 340/572 |
| 4,746,908 | 5/1988 | Montean | 340/572 |

FOREIGN PATENT DOCUMENTS

| | | | |
|---|---|---|---|
| 763681 | 11/1933 | France | 12/2 |

*Primary Examiner*—Joseph A. Orsino
*Assistant Examiner*—Anh H. Tran
*Attorney, Agent, or Firm*—Donald M. Sell; William B. Barte

[57] ABSTRACT

A magnetic marker for use with electronic article surveillance (EAS) systems in which a two-directional very high order harmonic response is obtained. The markers comprise two pairs of elongated strips of low coercive force, high permeability material positioned in a tic-tac-toe configuration such that the strips at right angles to an applied field of an EAS system collect and concentrate the lines of flux associated with the field into the strips parallel to the field, the concentrated flux being sufficient to result in a high harmonic response.

5 Claims, 3 Drawing Sheets

ECONOMIC, MULTI-DIRECTIONALLY RESPONSIVE MARKER FOR USE IN ELECTRONIC ARTICLE SURVEILLANCE SYSTEMS

FIELD ON THE INVENTION

This invention relates to electronic article surveillance (EAS) systems and markers used therein, and in particular, to such markers in which the magnetization of a piece of magnetic material in the marker is changed by an alternating magnetic field in an interrogation zone to produce detectable signals indicating the presence of the marker.

BACKGROUND OF THE INVENTION

It is now well known to utilize a piece of low coercive force, high permeability magnetic material as an EAS marker. Such markers were perhaps first disclosed in the French Pat. No. 763,681, issued in 1934 to Pierre Arthur Picard. More recently, it has become relatively well known to use particularly configured pieces, such as elongated strips of high permeability material, in order to enhance the production of very high order harmonics, thereby improving the reliability with which such markers can be distinguished over signals from other articles such as briefcase frames, umbrellas, etc. Such uses are exemplarily set forth in U.S. Pat. Nos. 3,665,449, 3,790,945 and 3,747,086. As such elongated strips are generally detectable only when the interrogating field is aligned with the strips, it is also known from such disclosures to provide for multi-directional response by providing multi-directional fields in the interrogation zone and by providing additional strips in an L, T or X configuration. Alternatively, in U.S. Pat. No. 4,074,249 (Minasy), it is proposed that multi-directional response may be obtained by making the strip crescent-shaped. Furthermore, it is known from U.S. Pat. No. 4,249,167 (Purington et al.) to make a deactivatable multi-directionally responsive marker by providing two elongated strips of permalloy arranged in an X configuration with a few hard magnetic pieces adjacent and co-linear to each of the permalloy strips.

While still recognizing that an elongated, or "open-strip" configuration is desired in order to obtain a very high order harmonic response, U.S. Pat. No. 4,075,618 (Montean) discloses that a marker capable of generating very high order harmonics, thereby being operative in a system such as described in the '449 patent, could be made by adding flux collectors to a short strip of high permeability material which is insufficiently long to meet the definition of an "open-strip". Picard also suggests that polar extensions may be provided to increase the sensitivity, while Fearon '945 suggest the use of pole piece coupons to collect flux.

Markers such as disclosed by Elder, Fearon, Peterson, Minasy and Montean in the above patents have all enjoyed certain commercial success. However, the use of the markers has been restricted by the size, and still primarily elongated shape heretofore believed to be necessary.

EAS systems in which the markers of the present invention are particularly useful typically produce within the interrogation zone fields in a variety of directions. For example, as disclosed in U.S. Pat. No. 4,300,183 (Richardson), such differently directed fields may be produced by providing currents in coils on opposite sides of the interrogation zone which are alternately in-phase and out-of-phase. The resulting aiding and opposing fields at any given location may be appreciably weaker in one direction than another. Accordingly, a given marker may be unacceptable if reliably detectable only when oriented in the direction associated with the strongest fields produced by the EAS system. Preferably, a commercially viable marker would have sensitivity so as to be reliably detectable regardless of how it is oriented in the zone, however, in a practical sense, it is not necessary to detect markers in each and every orientation and/or location in the zone.

Typical EAS systems designed to be used with elongated "open-strip" type markers are the Model WH-1000 and 1200 systems marketed by Minnesota Mining and Manufacturing Company. For example, such systems typically produce within the interrogation zones magnetic fields alternating at 10 kHz, and having minimum intensities at the center of the zone of approximately 1.2 oersteds (Oe) when the fields generated in coils on opposite sides of the zone are in an opposing configuration and of approximately 2.4 Oe when in an aiding configuration. The receiver portions of such systems process signals from receiver coils positioned within panels adjacent to the interrogation zone, and activate an alarm circuit in the event signals corresponding to very high order harmonics of the applied field are detected.

To compare the performance of various markers, it is convenient to use a test apparatus which generates fields alternating at a predetermined frequency and has controllable strength comparable to those encountered in such EAS systems. The test apparatus should detect signals in accordance with the harmonic characteristics relied upon in such systems and provide sensitivity values, based on a standard marker to ensure valid comparative results.

Such a test apparatus is preferably calibrated against a present commercially available marker such as type WH-0117 Whispertape brand detection strip manufactured by Minnesota Mining and Manufacturing Company, which is formed of an amorphous metal 6.7 cm long, 1.6 mm wide and 0.02 mm thick and having the following nominal composition (at %): Co:69%; Fe:4.1%; Ni:3.4%; Mo:1.5%; Si:10%; and B:12%, and which is available from Allied-Signal Corporation as type 2705M. Such a marker is inserted parallel with the field of the test apparatus and the gain is adjusted to indicate a standardized sensitivity value of 1.0 at a 10 kHz field of 1.2 oersteds, that being the minimum field strength at which such a marker would be expected to be reliably detected. At a higher field of 1.4 oersteds, a sensitivity of 4.8 was observed when the amorphous marker was similarly aligned.

It has long been desired to minimize the length of such elongated markers. However, short strips do not have sufficient sensitivity to be even marginally acceptable even at a high field strength and even when dimensioned to maximize high order harmonic response. Similarly, when short pieces are further dimensioned with polar extensions proportional to that depicted in FIG. 7 of Picard, in which the length of the center section is about eight times the center width and the overall length about 13 times the center width, the sensitivity is still unacceptable. For example, a 0.02 mm thick ribbon of the amorphous metal described above was cut to provide 2.5 cm long strips 1.6 mm, 0.8 mm and 0.5 mm wide. Also, a 2.5 cm long piece, 1.6 mm wide was provided with polar extensions according to "Picard". Relative sensitivities shown in the following table were then determined using the same procedure described above.

| Field Strength (Oe) | "Picard" marker with polar extensions on each end of a 1.6 mm wide strip | Strip Width (mm) and ($L/\sqrt{A}$ ratio) | | |
|---|---|---|---|---|
| | | 1.6 (140) | 0.08 (198) | 0.5 (250) |
| 1.2 | 0.02 | 0.014 | 0.034 | 0.037 |
| 2.4 | 0.26 | 0.18 | 0.18 | 0.017 |
| 3.0 | 0.46 | 0.28 | 0.25 | 0.025 |

It may thus be recognized that regardless of whether the strips were made very narrow, thus minimizing the demagnetization effects, or were made wider, thus providing a greater total mass, in all cases an unacceptable sensitivity level resulted. While the standardized sensitivity values of 0.02, 0.26 and 0.46 observed at the three field strengths noted above for the "Picard" type marker were superior to that observed for a strip alone, showing that increases in sensitivity do result by adding polar extensions as taught by the prior art, such benefits are still not sufficient to result in even a marginally acceptable marker.

SUMMARY OF THE INVENTION

In contrast to the elongated "open-strip"markers described above, wherein a desired high order harmonic response was obtained by keeping the length to square foot of cross sectional area above a certain minimum, and wherein a multi-directional response was suggested by combining such "open-strips" in an "X" or "L" configuration, the marker of the present invention obtains a high order harmonic, multi-directional response without requiring strips of the "open-strip" dimensions to be present. The present marker employs a plurality of short strips in which pairs of the strips are positioned parallel to each other at opposite sides of a closed planar shape, such as a square. Preferably, the ends of each strip are positioned to just overlap with the outside edge of an intersecting strip, however, the strips may also be inset a distance of up to 25% of the overall length, thus forming a "tic-tac-toe" configuration. The intersecting strips are magnetically coupled together. Accordingly, a first pair of pieces adjacent the opposite ends of a second pair of pieces collect and concentrate flux associated with a field parallel to the second pair of pieces within the second pair. Furthermore, with such a configuration, a multi-directional response is obtained, as flux associated with a field at an angle to the first field, and hence parallel the aforementioned first pair of pieces, will now be collected and concentrated by the second pair of pieces.

Each respective pair of pieces may function as flux collectors if appropriately aligned with respect to an external magnetic field, or will alternatively function as switching sections to generate the desired very high order harmonic response so long as the adjacent flux collecting pieces collect and concentrate a significant amount of flux. By so concentrating the magnetic flux, the effective flux density is increased so that the magnetization in switching pieces is very rapidly reversed upon each reversal of the applied field and very high order harmonics are generated at a given applied field intensity. It has also been found that the signals produced by such markers, while containing very high order harmonics upon which detection can be reliably based, also contain various other isolatable characteristics making the markers useful in other systems in which harmonics per se may not be isolated.

The magnetic pieces comprising the present marker preferably have overall lengths in the range between one-half and one and one-half inches (10–40 mm) and widths in the range between one thirty-second and three-sixteenths of an inch wide (0.8 to 4.8 mm), and preferably are formed of thin sheets, foils or ribbons ranging in thickness between 0.5 to 2 mil (0.01 to 0.05 mm). The above dimensions are provided only as a guide, and are not critical. Longer and narrower pairs of pieces behave more like "open-strips", hence the flux gathering benefits of the other pair of pieces become less necessary, however, the marker becomes objectionably large for many applications. Alternatively, while shorter pieces with flux collectors may be better for those applications, size reductions will ultimately preclude the generation of an acceptably detectable signal.

The pieces are desirably formed of high permeability, low coercive force magnetic materials such as permalloy, supermalloy or the like and of analogous amorphous materials such as the Metglas® alloys 2826MB2 and 2705M, etc. manufactured by Allied-Signal Corporation, and the Vitrovac® alloys 6025X, 6025Z-2, etc., manufactured by Vacuumschemelze GmbH.

A marker such as described above is conveniently made dual-status, i.e., reversibly deactivatable and reactivatable by including at least one piece of remanently magnetizable material adjacent the high permeable, low coercive force pieces, which piece when magnetized provides fields which bias the magnetization of the adjacent low coercive force piece to alter the response of the marker resulting from the alternating magnetic field encountered in the interrogation zones.

DETAILED DESCRIPTION

Figure 1:
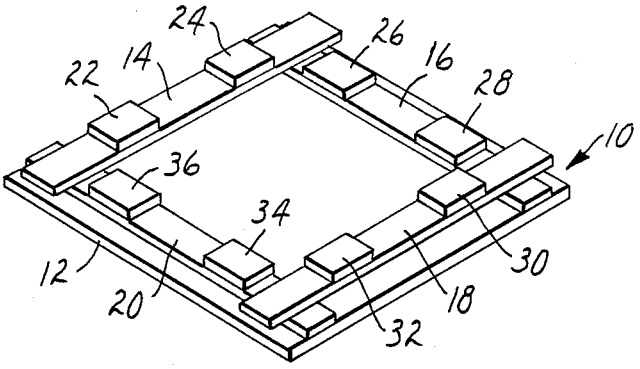
FIG. 1 is a perspective view of one embodiment of a deactivatable marker of the present invention.

As shown in the perspective view of FIG. 1, in one embodiment of the present invention the marker 10 comprises a substrate 12 on which are positioned four strips, 14, 16, 18 and 20 respectively, of a low coercive force, high permeability material, such as permalloy. As is also there shown, each of the strips is positioned so as to be magnetically coupled to an intersecting strip near the respective ends. As the operation of the marker is largely dependent upon the extent of magnetic coupling between the intersecting strips, it is desirable that the strips at the points of intersection be positioned as closely together as possible. Accordingly, while the strips may be joined together via a thin layer of adhesive, it is preferred that each of the strips be adhered to the supporting substrate 12 such that no adhesive is at all present between the strips at the respective points of intersection. If further desired, a protective overlayer (not shown) may be added and further adhered to the substrate 12 so as to sandwich the strips therebetween, and further press the strips together at the respective intersections.

In the embodiment of FIG. 1, the marker 10 is further made dual status so as to be selectively deactivatable and reactivatable. Such a feature is provided by including with each of the strips 14, 16, 18 and 20 respectively at least one section, of a remanently magnetizable material such as vicalloy. Thus as shown in FIG. 1, strip 14 is provided with two pieces 22 and 24 of vicalloy, strip 16 is provided with two such pieces 26 and 28, strip 18 is provided with two pieces 30 and 32 and strip 20 is provided with two pieces 34 and 36. In a manner similar to that discussed above, the magnetizable pieces must be magnetically coupled to the adjacent low coercive force, high permeability pieces such that when the magnetizable pieces are magnetized, the external magnetic field associated with the magnetized state of each piece is coupled to the adjacent high permeability piece so as to bias that piece and affect the magnetization reversal of that piece when the marker is exposed to the alternating field typically present in an interrogation zone. Thus each of the magnetizable pieces are desirably positioned on top of the high permeability piece without an intervening adhesive layer, however, such a layer may be present, and the total assembly maintained in position via an adhesively bonded top cover layer (not shown).

In a preferred construction, a marker of FIG. 1 desirably has overall dimensions approximately 1 inch square. Thus the substrate 12 may be provided of a dielectric sheet such as kraft paper, relatively stiff plastic or the like. Each of the high permeability pieces 14 through 20 is desirably a strip of permalloy approximately 1 inch long and 0.1 inch wide, such strips being cut from a sheet of such material 0.6 mils thick. In such a construction, the magnetizable pieces 22 through 36 are small rectangles of vicalloy having approximately the same width (0.10 inch) and a length extending along the length of each of the underlying strips of approximately 0.25 inch. Such chips are readily cut from a sheet of such a material.

The performance of the marker as shown in FIG. 1 is strongly effected by the magnetic coupling at the intersections of the adjoining strips. Thus, the strips may be joined at the respective intersections by a thin layer of pressure-sensitive adhesive or the like. However, it is preferable that the gap resulting from such an adhesive layer be maintained as thin as possible. In a more preferred construction, a layer of pressure-sensitive adhesive may be utilized to adhere each of the respective strips directly to the substrate 12 such that the strips are in intimate physical contact at the intersecting locations without any adhesive or the like separating the respective strips. Furthermore, also not shown in FIG. 1, a top protective layer may be added to both protect the strips, provide a printable surface for suitable customer identification indicia to be added and further, as it may be directly bonded to the substrate 12 to press the respective strips together at the intersections, so as to further improve the extent of magnetically coupling.

In order to demonstrate the effectiveness of a "tic-tac-toe" configuration such as shown in FIG. 1, a series of experiments were performed in which strips of constant length but varying width foils were assembled, with varying amounts of each strip overlapping the ends of the adjacent intersecting strip. Specifically, strips of an amorphous material, type 270 5M obtained from Allied-Signal Corporation, which material has the following nominal composition (at %): Co:69%; Fe:4.1%; Ni:3.4%; Mo:1.5%; Si:10% and B:12%, 0.8 mils thick, were prepared in strips of one inch long and in widths ranging in 0.02 inch increments from 0.02 to 0.12 inch. These strips were assembled in three sets, one set having the ends directly abutting so that there was no material extending beyond the intersections, while the second and third sets had 0.1 inch and 0.2 inch of the material extending beyond the intersections, respectively. Such sample markers were then tested in the aforedescribed apparatus which generates alternating fields at a predetermined frequency and intensities comparable to those encountered in electromagnetic article surveillance (EAS) systems. This apparatus was constructed to detect signals in accordance with harmonic characteristics relied upon in such EAS systems and to provide sensitivity values based on a standard marker to ensure valid comparative results. Such a standard marker is desirably formed of a strip of the same composition, amorphous metal foil, 2 $\frac{5}{8}$ inches long by 1/16th inch wide by 0.0008 inch thick.

When such a marker was inserted parallel with the field of test apparatus and the gain was adjusted to a standardized sensitivity, a sensitivity value of approximately 4 volts at a peak field intensity of 2 oersteds was obtained. To provide a direct comparison with the 1 inch long strips used in the samples of the present invention, such a standardized marker was then cut to a length of 1.0 inches and the equivalent sensitivity at a peak intensity of 2.0 oersteds was determined to be 0.08 volts. Similarly, when two such 1 inch long strips were assembled side-by-side and spaced approximately 1 inch apart but without a pair of opposing and magnetically coupled intersecting strips present, the sensitivity of the two strips was not quite double that previously observed, i.e., a sensitivity value of about 0.13 volts was observed. The resultant sensitivities observed for the series of markers of varying widths and varying amounts of overlap are set forth below in Table I. These markers were prepared with each adjacent metal strip being in intimate ohmic contact with the intersecting piece. Furthermore, two markers of each dimension were prepared and each was measured in the test apparatus by first inserting the marker along to have one pair of strips parallel to the applied field, then by removing it, rotating it 98° and inserting it so that the other pair of strips was parallel to the applied field. The measured sensitivity values for all four cases were then averaged. The average results are indicated in Table I.

As noted above, the response of a single elongated strip, such as used in forming the "tic-tac-toe" marker, is known to be extremely sensitive to the extent of elongation, such an extent being generally characterized by the ratio of the length over the square root of the cross-sectional area $$(L/\sqrt{A}).$$

Thus, for example, the $L/\sqrt{A}$ ratio for the standardized $2\frac{5}{8}$ inch long marker is approximately 370, which is known to produce a readily highly detectable signal. In contrast, the 1 inch strip of such a piece has an equivalent ratio of about 140, which is less than that required to produce an adequate signal. The equivalent ratio for the strips in the samples set forth in Table I is there indicated. The effect of providing the flux collectors at right angles may be seen in Table I to raise the corresponding sensitivity from 0.13 up nearly a factor of 5 when the respective strips were inset a distance of 0.02 inch, and nearly a factor of 7 when the strips were positioned with 0 extensions.

TABLE I

| | Extension Beyond End of Strips | | | | | |
|---|---|---|---|---|---|---|
| | 0 | | 0.1" | | 0.2" | |
| Width of Strips | $L/\sqrt{A}$ | Sensitivity | $L/\sqrt{A}$ | Sensitivity | $L/\sqrt{A}$ | Sensitivity |
| 0.02 | 277 | 1.04 | 219 | 0.81 | 162 | 0.61 |
| 0.04 | 188 | 0.72 | 147 | 0.69 | 106 | 0.56 |
| 0.06 | 147 | 0.85 | 113 | 0.69 | 80 | 0.58 |
| 0.08 | 121 | 0.88 | 92 | 0.66 | 63 | 0.51 |
| 0.10 | 103 | 0.72 | 77 | 0.67 | 52 | 0.48 |
| 0.12 | 90 | 0.86 | 66 | 0.64 | 42 | 0.43 |

The effect of efficiently coupling the pieces together at the intersections is further set forth in Table II in which 0.06 inch wide one inch strips of the same material as used in the previous examples were assembled with zero extensions at the intersections but in which varying thicknesses of adhesive were provided separating the adjoined pieces. As shown, when as much as 0.010 thick layer of adhesive separated the intersecting pieces, the resultant sensitivity was decreased nearly to the extent noted above, wherein two pieces of the same length were placed one inch apart side-by-side and no intersecting flux collectors were present.

TABLE II

| Adhesive Thickness (inches) | Sensitivity |
|---|---|
| 0 | 0.85 |
| 0.001 | 0.46 |
| 0.003 | 0.35 |
| 0.010 | 0.22 |

Figure 2:
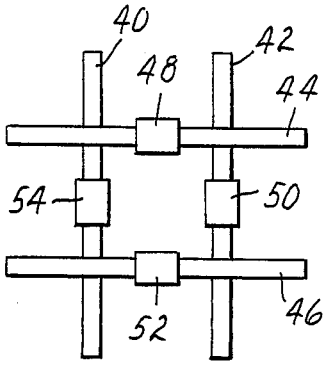
FIG. 2 is a top view of another embodiment of the marker of the present invention.

An alternative embodiment to that described in FIG. 1 is set forth in FIG. 2, wherein the four strips 40, 42, 44, and 46 of high permeability, low coercive force material were assembled as noted above with approximately 20% of the entire width of each strip extending beyond the intersections of an intersecting strip. In this embodiment, a single magnetizable element 48, 50, 52 and 54 respectively was positioned at the center of each of the strips 40 through 46. While such a configuration has been found to produce a significant change in the sensitivity of the resultant marker depending upon whether or not the magnetizable elements 48 through 54 are in fact magnetized or not, the change in the resultant response was found not to be as significant as found when two such materials are provided on each strip as shown in FIG. 1.

Figure 3:
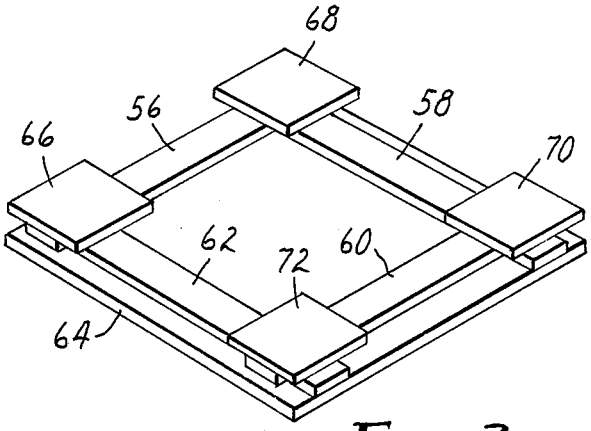
FIG. 3 is a perspective view of another deactivatable marker, according to another embodiment of the present invention.

A yet more desirable embodiment is shown in FIG. 3 wherein elongated strips 56, 58, 60 and 62 are shown assembled on an underlying substrate 64 as in FIG. 1 but wherein magnetizable elements 66, 68, 70 and 72 are positioned at the intersections of each of the respective strips. In an embodiment in which a 0.060 inch wide strips of one inch long amorphous metal as described above were assembled with zero adhesive between the adjoining strips, the sensitivity in a 2 oersted field was observed to be about 0.8 volts, and, the presence of an unmagnetized 3/16 inch square chip of vicalloy at each intersection was found to not result in any observable change in the sensitivity. The same marker, but with one quarter inch square vicalloy chips at each of the four intersections was observed to have a slightly lower sensitivity of 0.49 volts. When the vicalloy chips were magnetized, it was found that the signals from the markers were at least two orders of magnitude less intense.

Figure 4:
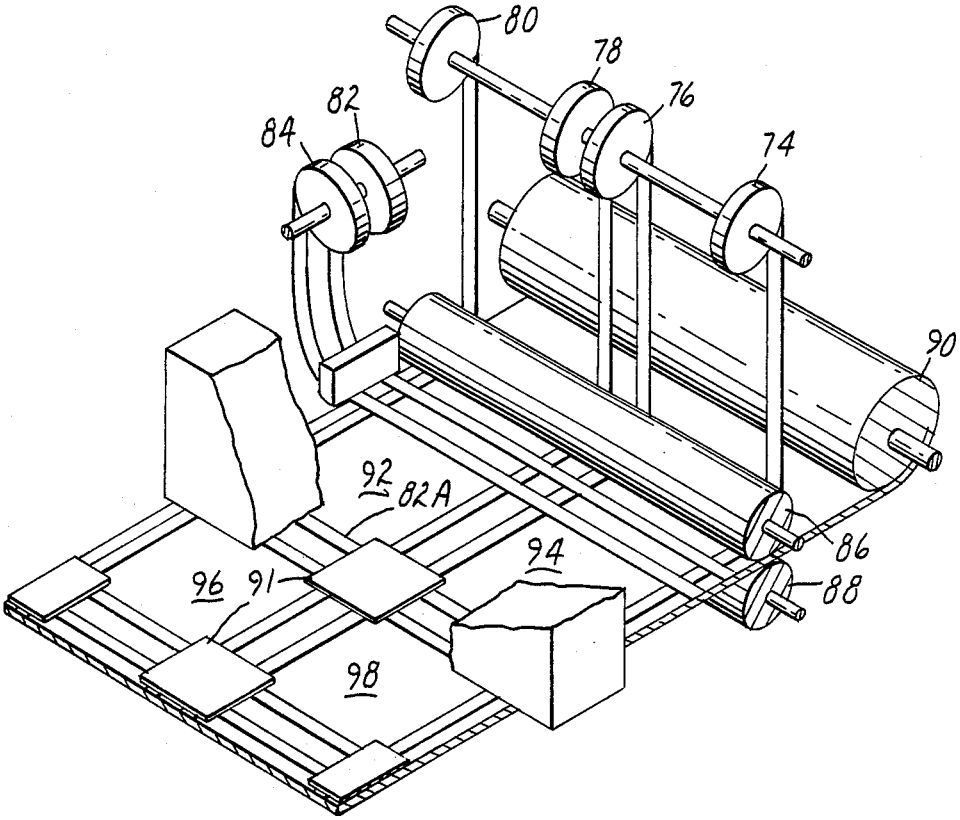
FIG. 4 illustrates a method for economically producing the markers of the present invention.

Mass produced multi-directionally responsive markers of the present invention are desirably made by a series of laminating and slitting operations. Thus, for example, as shown in FIG. 4, rolls 74, 76, 78, 80, 82 and 84 respectively, of high permeability material having the appropriate width and thickness, such as 0.06 inch wide and 0.015 mm thick rolls of permalloy, are provided with a layer of pressure-sensitive adhesive on the bottom surface. The respective rolls 74 and 76, and 78 and 80, are positioned at a center-to-center distance of one inch from each other, with the distance between the rolls 76 and 78 and 82 and 84 being adjusted to control the extent of desired extension at the intersections of the adjacent strips of the markers to be formed. As shown, the material on the rolls 74 through 80 and a support web from roll 90 are passed between rollers 86 and 88, causing the respective strips to adhere to the support web. The rolls 82 and 84 are similarly positioned and in a start-stop operation, the material from those rolls is also adhered to the support. A hopper containing one inch square chips 91 of vicalloy is positioned down-web and suitably activated to thereafter position square of that material as there shown. Markers 92, 94, 96 and 98 were thus formed, albeit not yet separated.

As further shown in the top view of FIG. 5, the resultant laminations may be subsequently separated by shearing along the dashed lines 100, 102, 104 and 106 respectively. In a particularly preferred embodiment, where rolls of the resultant markers are desirably provided, a full cut through the support web 90 may be provided along the cut lines 100 and 102, while the web is left only partially severed along cut lines 104 and 106, thus allowing the resultant markers to be dispersed in roll form and subsequently broken apart while the magnetic material is completely severed at the respective shear lines 104 and 106.

Figure 5:
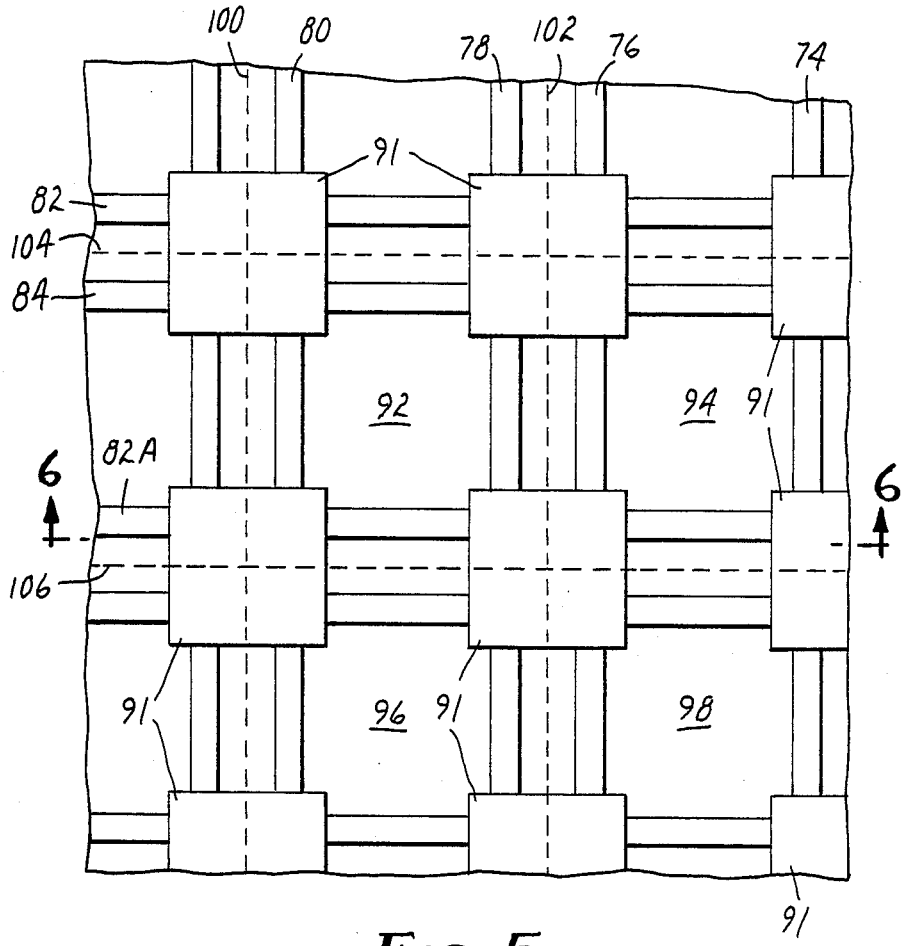
FIG. 5 is a partial top view of a sheet containing a number of as yet unseparated markers made according to the method of FIG. 4.
Figure 6:
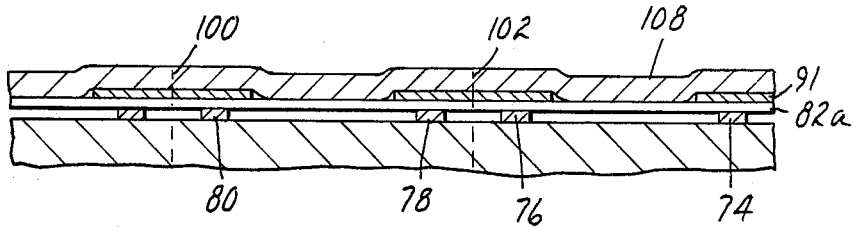
FIG. 6 is a side view taken along the line 6—6 in FIG. 5.

Further details of the resultant strips after the final laminates are formed are shown in the cross sectional view of FIG. 6, taken along the lines 6—6 of FIG. 5. In FIG. 6 it may be seen that the top surface of the metal strips 74, 76, 78, 80 and 82A are covered by a protective top layer 108 which also force the pieces of high coercive force magnetizable materials 91 into close magnetic coupling with the intersecting strips of high permeability, low coercive force material. Likewise, the piece 108 will thus be similarly secured to the underlying support 90 in the regions where no strips occur, resulting in a tightly bonded together, finished construction, having both upper and lower surfaces suitable for the addition of customer indicia.

In the multi-directionally responsive markers described above with regard to FIGS. 4–6, keeper chips 91 are shown to have been placed above the intersections of each of the adjoining strips of low coercive force, high permeability material. When the keeper chips are magnetized, the external field associated therewith prevents the magnetization in the portions of the strips adjacent the keeper chips from reversing, thereby both eliminating any flux collecting action on the part of the strips normal to an applied field of an interrogation zone and appreciably shortening the length of the strips that are parallel to the applied field such that a non characteristic response thus occurs. While such an embodiment is preferably due to the high level of desensitization thus produced, it is similarly within the scope of the present invention that a single or multiple keeper chips may be disposed along the length of each of the elongated strips as set forth in FIGS. 1 and 2.

While the markers described above with regard to the preferred embodiments of the present invention are desirably made of an amorphous alloy of a given composition, it is also within the scope of the present invention that a number of high permeability, low coercive force materials may be used. Thus, for example, a number of amorphous alloys, both iron and nickel based, as well as the cobalt based alloy described above, may be utilized, as may be a large variety of crystalline materials, such as permalloy, supermalloy and the like. Similarly, the material used as the keeper chips may be formed of a variety of permanently magnetizable, yet relatively low coercive force materials. While vicalloy has been described hereinabove as a preferred material, similar chips for desirable markers may be formed of silicon steel, magnetic stainless steels, and the like.

I claim:

1. A marker for use in an electronic article surveillance system of the type in which an alternating magnetic field in an interrogation zone produces remotely detectable magnetization changes in the marker, wherein the marker comprises at least two pairs of strips of a high permeability, low coercive force, magnetic material, both pairs of strips being positioned in substantially the same plane, with the strips of each pair being positioned to be substantially parallel to each other and intersecting with the strips of the other pair and dimensioned so as to overlap and be magnetically coupled therewith, the extent of such overlap being such that less than 25% of the length of each strip extends beyond the side of an intersecting strip of another pair, the strips of a first pair thereby forming flux collectors to concentrate flux from fields extending substantially parallel to the strips of the second pair into the strips of the second pair.

2. A marker according to claim 1, wherein all of said strips are substantially the same dimension.

3. A marker according to claim 1, wherein all of said strips are substantially the same composition.

4. A marker according to claim 1, further comprising at least one section of permanently magnetizable material positioned adjacent to each of said strips, and magnetically coupled thereto such that when so magnetized the detectable response resulting from the marker is altered.

5. A marker according to claim 4, wherein a piece of permanently magnetizable material is positioned over the intersections of said strips.

* * * * *